United States Patent [19]

King

[11] 4,055,479

[45] Oct. 25, 1977

[54] FLUID TREATER HAVING ELECTRIC FIELD WARPING MEANS

[76] Inventor: Arthur S. King, 8021 Cherokee Lane, Leawood, Kans. 66206

[21] Appl. No.: 713,250

[22] Filed: Aug. 10, 1976

[51] Int. Cl.[2] ..... B03C 5/02

[52] U.S. Cl. ..... 204/302; 204/305

[58] Field of Search ..... 204/302–308, 204/149, 186

[56] References Cited

U.S. PATENT DOCUMENTS

| | | | |
|---|---|---|---|
| 3,454,484 | 7/1969 | King, Jr. et al. | 204/186 |
| 3,766,050 | 10/1973 | Pados | 204/302 |
| 3,972,800 | 8/1976 | King | 204/302 |

OTHER PUBLICATIONS

B. Q. Welder et al, "Practical Performance of Water--Conditioning Gadgets", *Industrial & Eng. Chem.,* vol. 46, pp. 954–960 (1954).

R. Eliassen et al, "Experimental Performance of 'Miracle' Water Conditioners", *J. Am. Water Works Assn.,* Oct. 1968, pp. 1371–1385.

E. Nordell, "Water Treatment", Reinhold Pub. Corp., 1961, pp. 270–272.

R. Eliassen et al, "Experimental Evaluation of 'Water Conditioner' Performance", *J. Am. Water Works Assn.,* Sept. 1957, pp. 1179–1190.

Editorial "Watch Out for Wondrous Water Treatment Witchcraft", *Materials Performance* (1974), p. 9.

James, "Water Treatment", pp. 166–167 (1965).

R. Eliassen et al, "So-called Electrical & Catalytic Treatment of Water For Boilers", *J. Am. Water Works Assn.,* July 1952, pp. 576–582.

Anon., "Federal Trade Commission Decision on Evis Water Conditioner Claims", *J. Am. Water Works Assn.* pp. 708–710 (1959).

T. Hurley et al, "Electrical Treatment of Boiler Feed Waters", *J. Inst. Water Eng., pp. 686–688, 698, 699 (1951).*

Editorial, "Gypping The Gullible", *J. Electrochem. Soc.,* vol. 100, p. 209e (1953).

Editorial, "Why be a Gadget Sucker?", *Corrosion,* July 1960.

*Primary Examiner*—John H. Mack
*Assistant Examiner*—Aaron Weisstuch
*Attorney, Agent, or Firm*—Schmidt, Johnson, Hovey & Williams

[57] ABSTRACT

The concentrically disposed inner and outer electrodes of the treater are electrically insulated from one another across the annular treating region therebetween such that fluid flowing through the region is exposed only to an electric force field and not to electrical current flow. The lines of force between the two electrodes would normally extend radially across the region, but the introduction of a ring of separate conductors around the inner electrode and in parallelism therewith causes the field to be warped into a series of discrete concentrations as the region is circularly traversed. As a result of their insertion into the electric field, the warping conductors become oppositely charged over the two oppositely facing halves thereof, each conductor having its half facing the inner electrode charged oppositely to such inner electrode, while the half facing the outer electrode is charged oppositely of the outer electrode. Such charging phenomena increases the effect on the fluid flowing through the treater.

10 Claims, 4 Drawing Figures

2.
2.

FLUID TREATER HAVING ELECTRIC FIELD WARPING MEANS

This invention relates to the treatment of fluids, such as water, through electricity so as to change the properties of the fluid to produce an intended, beneficial result, such as, for example, causing solids suspended in a liquid to more readily precipitate out of suspension, preventing the formation of scale within metal water pipes, and removing existing scale encrustations from such pipes. Suitable devices for accomplishing such goals are illustrated, for example, in my prior U.S. Pat. Nos. 3,585,122, and 3,972,800.

One important object of the present invention is to improve upon the teachings of said prior patents by providing a way in which the intensity of the electric fields of the disclosed treaters can be effectively increased without first increasing the power supplied to the treaters, thereby increasing the effect on the fluid at a given power level and reducing the amount of power heretofore required to achive a given fluid effect.

Pursuant to the foregoing, another important object of this invention is to provide a relatively uncomplicated yet reliable way of warping the normally radial electric field of such treaters into a series of separated, discrete concentrations of lines of force which traverse the region between the inner and outer electrodes such that fluid flowing helically in the treaters around their inner electrodes are subjected to highly concentrated, repetitious exposures of the force lines.

An additional important object of this invention is to further increase the electric effect upon a fluid at a give power level by causing the structure which warps the electric field to assume charges of opposite polarity on their opposite sides that face the inner and outer electrodes of the treaters, in each case the charges on the side of the conductor facing an electrode being opposite in polarity to the charge of that particular electrode.

Figure 1:
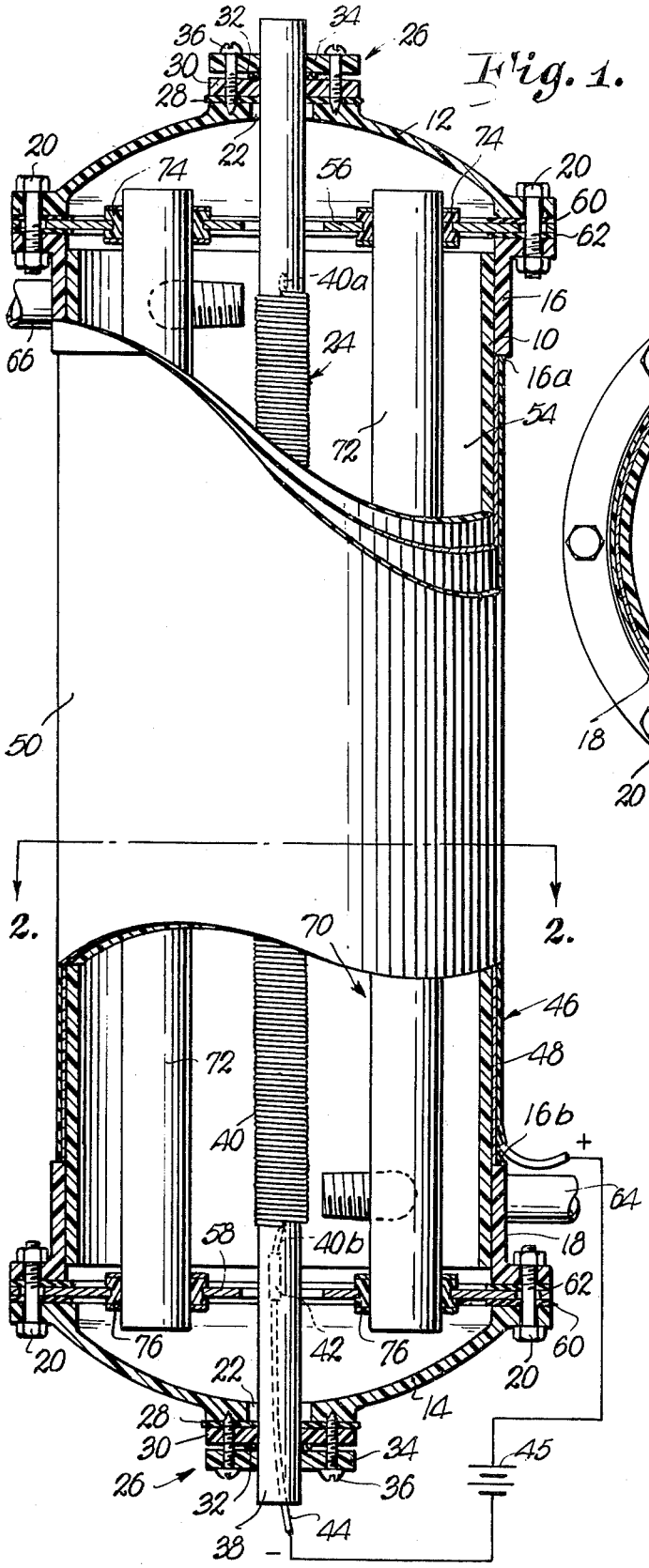
FIG. 1 is an elevational view of a treater constructed in accordance with the principles of the present invention, parts of the treater being broken away and illustrated in cross-section for clarity.

The treater has a continuous, annular wall 10 and a pair of opposite, domed endcaps 12 and 14 that are removably secured to a pair of fitting collars 16 and 18 at opposite ends of the wall 10. The collars 16 and 18 are bonded or otherwise rigidly attached to the wall 10, and the attachment of the endcaps 12 and 14 to the collars 16 and 18 is made by releasable fasteners 20. Preferably, the wall 10, endcaps 12 and 14 and collars 16 and 18 are all constructed from a dielectric material such as polyvinyl chloride.

The two endcaps 12 and 14 each have a hole 22 therethrough which receives an elongated, inner electrode 24 extending slightly outwardly beyond the two endcaps 12 and 14. The enlarged holes 22 serve only to clear the electrode 24 and not to support the same, this function being provided by a retaining assembly 26 on the exterior of each endcap 12, 14, respectively. Each assembly 26 includes a gasket 28 that surrounds the extending portion of the electrode 24 and immediately overlies the hole 22. In addition, the assembly 26 has an annular plate 30 overlying the gasket 28 and receiving the electrode 24, an O-ring 32 overlying the plate 30 and receiving the electrode 24, and an annular clamping plate 34 which overlies the O-ring 32 and also receives the electrode 24. Screws 36 complete the assembly 26 and serve to draw the plates 30 and 34 tightly toward the endcap 12 or 14 such as to in turn squeeze the O-ring 32 tightly about the electrode 24 and to effect a fluid-tight seal at the gasket 28. In this manner, the electrode 24 is firmly held at its opposite ends by the assemblies 26, and the fluid to be treated within the treater is precluded from escaping at these locations.

The inner electrode 24 is illustrated as comprising a tubular support member 38 constructed of dielectric material and a conductive element 40 wound helically around the support member 38 in a series of tight convolutions which are in close proximity to one another. The normally uppermost end **40*a* of the element 40 is terminated inside of the member 38, while the normally lower terminal end 40*b* of the element 40 is inserted through the wall of the member 38 to terminate inside the latter in the same manner as the upper end 40*a*. However, a connection 42 is made within the interior of the member 38 between lower end 40*b* and a lead 44 which continues through the member 38 from the connection 42 and emerges from the lower end of the member 38 for connection to one side of a source 45 of electrical potential. Preferably, such potential is direct potential such as supplied by a suitable power pack, and the lead 44 is so connected that the electrode 24** is adapted for negative charging thereof.

An outer, cylindrical electrode 46 is defined by a layer of metal foil 48 that is wrapped about the wall 10 between opposite, upper and lower shoulders **16*a* and 16*b* of the collars 16 and 18, respectively. A suitble dielectric jacket 50 surrounds the foil layer 48 as a safety measure, and a lead 56 is electrically connected to the layer 48 adjacent the shoulder 16*b* for connection to the positive side of the source 45** of direct potential abovementioned.

Figure 2:
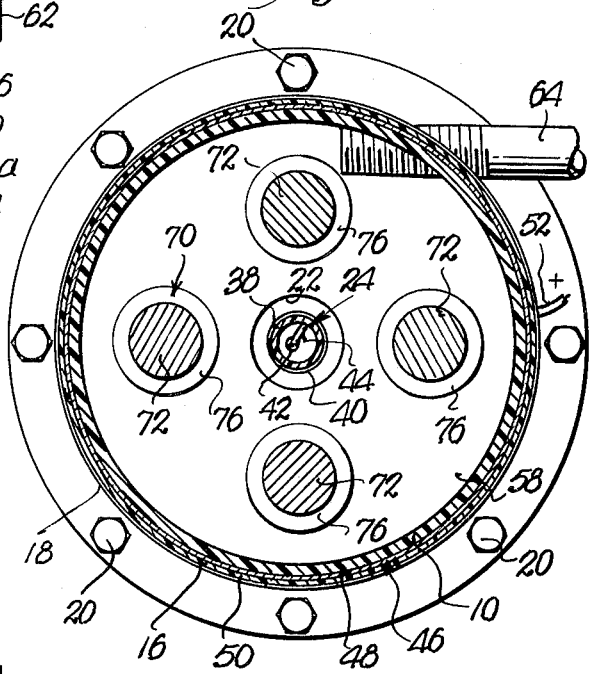
FIG. 2 is a transverse, cross-sectional view thereof taken along line 2—2 of FIG. 1.

The wall 10 and the inner electrode 24 are disposed in concentric relationship to one another, thereby establishing the same relationship between the outer electrode 46 and the inner electrode 24. An annular treating region 54 of uniform transversely cross-sectional width is thereby defined between the wall 10 and the inner electrode 24, and such region 54 extends longitudinally between a pair of normally upper and lower partitions 56 and 58, respectively, that are clamped between the endcaps 12, 14 and collars 16, 18. A pair of suitable gaskets 60 and 62 on opposite sides of each partition 56, 58, respectively, provide a fluid-tight seal at the interface between the partitions 56, 58 and their respective endcaps 12, 14 and collars 16, 18. Entry to the treating region 54 is provided by a tangentially disposed inlet 64 adjacent the lower partition 58, while exit from the region 54 is provided by a tangentially disposed outlet 66 adjacent the upper partition 56. Fluid introduced into the treater through inlet 64 is thereby induced to spiral upwardly around the inner electrode 24 through the region 54 in a counterclockwise direction viewing FIG. 2 whereupon it may leave the region 54 through the outlet 66.

From the construction thus far described, the treater is fully operational to electrically treat a fluid which is passed through the region 54, since when electrodes 24 and 46 are connected across opposite sides of a source of electrical potential, an electrical field is established within the region 54. By virtue of the presence of the dielectric wall 10, there is no electrical current flow beween the electrodes 24 and 46, although an electric field is created as a result of the opposite charges on the electrodes 24 and 46. Such field is radial in nature having lines of force which extend radially outwardly from the inner electrode 24 to intersect perpendicularly with the outer electrode 46 as illustrated by the broken lines 68 of FIG. 4. It is to be noted, however, that such a radial pattern of force lines is necessarily more intense immediately adjacent the inner electrode 24 then along the outer electrode 46 because the force lines 68 are closer together in the vicinity of the inner electrode 24 than near the outer electrode 46. Consequently, the effects of the field upon the fluid are substantially less in the radially outer part of the region 54 than in the radially inner part thereof.

Figure 3:
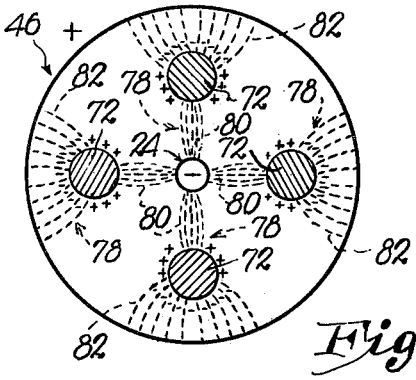
FIG. 3 is a diagrammatic view of the treater on a reduced scale illustrating the field warping phenomena that takes place during operation of the treater.

In accordance with the principles of the present invention, therefore, structure 70 is inserted into the region 54 between the electrodes 24 and 46 to produce a series of intense, force line concentrations having a pattern as illustrated in FIG. 3. In the illustrated embodiment the structure 70 comprises a ring of four elongated, solid conductor bars 72 of circular transverse configuration. Each of the bars 72 extends the full length of the region 54 and is retained in parallelism with the electrodes 24 and 46 by a pair of upper and lower, insulated grommets 74 and 76, respectively, carried by the partitions 56 and 58. The ring formed by the bars 72 is concentric with the inner and outer electrodes 24 and 46, respectively.

None of the bars 72 is connected through a lead to any source of electrical potential. They are conductors alone, not electrodes, and are preferably constructed of copper or another suitable metal, although carbon may also be utilized in certain circumstances.

Figure 4:
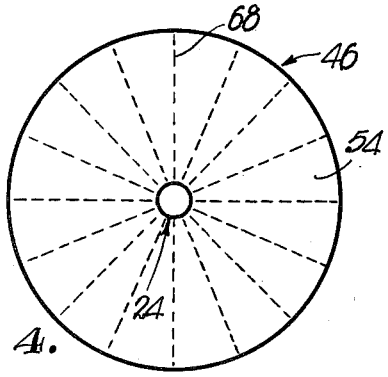
FIG. 4 is a schematic illustration on a reduced scale of a prior art treater illustrating a radial electric field.

As a result of the introduction of the bars 72 into the region 54, the otherwise radial electric field (as illustrated in FIG. 4) is warped into the non-uniform electric field illustrated in FIG. 3 wherein discrete concentrations 78 of force lines are produced between the electrodes 24 and 46. Each concentration 78 includes an inner set 80 of force lines between the inner electrode 24 and the bar 72, plus an outer set 82 of force lines between the bar 72 and the outer electrode 46. Thus, although the outer electrode 46 is many times larger in diameter than the inner electrode 24, the force lines adjacent the outer electrode 46 are fairly close together, at least relative to those in FIG. 4. Hence, fluid that is swirled around the inner electrode 24 is repeatedly suject to substantial field intensity not only in the immediate vicinity of the inner electrode 24, but also along the outer electrode 46. This has the effect, for a given level of power, of intensifying the electric field heretorfore available such that a more powerful action is obtained. Viewed another way, it can be stated that the same effect can be applied against the fluid as with a radial field, but with less power requirements.

It is also believed that insertion of the bars 72 into the electric field causes the bars 72 to assume opposite charges on their two semicircular sides. For example, assuming that the inner electrode 24 is negatively charged, the sides of the bars 72 that face the electrode 24 will become positively charged. On the other hand, assuming that the outer electrode 46 is positively charged, the sides of the bars 72 facing the outer electrode 46 will be negatively charged. It is believed that this phenomena further enhances the electrical effect of the warped field on the fluid being treated such that a higher degree of efficiency is obtained.

It is to be understood that the treater construction as hereinabove described has been selected for purposes of example only and that the treater itself may take several different forms. In this regard, it will be noted that the treaters of the two aforementioned patents are of basically different constructions, one using a metal outer housing or wall and the other utilizing a polyvinyl chloride outer wall as in the presently illustrated construction. The field warping principles of the present invention are equally applicable to either and both of such constructions.

The treater of the present invention may be applied to a number of different fluid treatment situations. One example is as a scale remover and scale preventer in water systems where "hard" water has a tendency to form encrustations on the interior surfaces of water lines of the system. It has been found that treaters of this general character, wherein one electrode is insulated from the other such that no elecrical current flow can exist, perform admirably in preventing the accumulation of scale. On the other hand, it has also been found through long experience that if such treaters are connected in the flow pattern of systems having existing scale problems, over a prolonged period of time, the existing scale will eventually be removed and the pipes maintained clean and unclogged.

It has also been found that treaters of this type are useful in accelerating the precipitation of suspended solid materials out of suspension. Such has been found to be the case in many different situations where suspended solids of various types are desired to be removed prior to discharging the waste water into a river or stream.

Having thus described the invention, what is claimed as new and desired to be secured by Letters Patent is:

1. In a device usable for treating fluids to induce precipitation of suspended solid material wherein the fluid is passed through the annular region between a tubular outer electrode and an inner electrode of substantially smaller diameter coaxially housed within the outer electrode, said electrodes being electrically insulated from one another to preclude electrical current flow across said region but to establish an electric field having radial lines of force spanning said region, the improvement comprising:

structure between the two electrodes for warping said force lines into discrete, circumferentially separated concentrations to render the field nonuniform as the region is circularly traversed.

2. In a device as claimed in claim 1, wherein said warping structure includes at least one elongated conductor extending parallel to said inner electrode within said region.

3. In a device as claimed in claim 2, wherein said electrodes are provided with conductive leads connecting the same to a source of electrical potential, said conductor being devoid of such leads.

4. In a device as claimed in claim 3, wherein said conductor is of circular, transverse cross-section, having a larger diameter than said inner electrode.

5. In a device as claimed in claim 1, wherein said warping structure includes a ring of elongated conductors about said inner electrode, each conductor extending in parallel relationship to the inner electrode.

6. In a device as claimed in claim 5, wherein said electrodes are provided with conductive leads connecting the same to a source of electrical potential, said conductor being devoid of such leads.

7. In a device as claimed in claim 6, wherein each conductor is of circular, transverse cross-section, having a larger diameter than said inner electrode.

8. In a device as claimed in claim 1, wherein there is provided an annular wall of dielectric material defining the outer limit of said region and presenting electrical insulation between said electrodes, said outer electrode comprising a layer of conductive foil wrapped around the exterior of said wall.

9. In a device as claimed in claim 1, wherein said inner electrode comprises an elongated, electrically insulating support and an electrically conductive element wound helically around said support.

10. In a device as claimed in claim 1, wherein said inner electrode is adapted to be negatively charged and said outer electrode is adapted to be positively charged.

* * * * *